United States Patent [19]

Santore

[11] 3,955,712

[45] May 11, 1976

[54] BOTTLE STOPPER

[76] Inventor: Anthony Santore, 249 Calhoun Ave., Bronx, N.Y. 10465

[22] Filed: Sept. 12, 1974

[21] Appl. No.: 505,478

[52] U.S. Cl. ..... 222/80; 222/484; 222/519; 222/552

[51] Int. Cl.[2] ..... B65D 47/06

[58] Field of Search ..... 222/80, 484, 519, 522, 222/552; 220/289; 215/309, 314, 356

[56] References Cited

UNITED STATES PATENTS

| | | | |
|---|---|---|---|
| 116,245 | 6/1871 | Warth | 222/519, X |
| 693,161 | 2/1902 | Schies | 215/356 |
| 1,472,817 | 11/1923 | Stansbury | 222/522 X |
| 2,167,476 | 7/1939 | Diefenbach | 222/484 X |
| 2,549,225 | 4/1951 | Moy | 222/484 X |
| 3,051,349 | 8/1962 | Howard | 220/289 |
| 3,197,091 | 7/1965 | Millard | 222/522 |
| 3,262,613 | 7/1966 | Miller | 222/522 |

FOREIGN PATENTS OR APPLICATIONS

| | | | |
|---|---|---|---|
| 490,070 | 7/1952 | Italy | 222/522 |

*Primary Examiner*—Robert B. Reeves
*Assistant Examiner*—F. R. Handren
*Attorney, Agent, or Firm*—Henry Sternberg

[57] ABSTRACT

A hollow stopper for dispensing fluid from a bottle having a neck and a top lip is provided. The stopper comprises a top wall having a laterally extending, downwardly open, spout-like protrusion. The top wall has a continuous, annular, uninterrupted undersurface for sealing engagement with the top lip of a bottle. An annular skirt depends from the top wall inwardly of said undersurface. The skirt is adapted to fit within the neck of a bottle and to move axially with respect thereto between a sealing position in which said undersurface is in sealing engagement with the bottle lip and a plurality of dispensing positions in which said undersurface is spaced from the bottle lip. The skirt includes an axial pouring slot extending from the top wall undersurface along one side of the skirt in alignment with the spout-like protrusion. The skirt also has a continuous, substantially axial, air-admitting channel substantially diametrically opposite the pouring slot and extending from the top wall substantially the full length of the skirt.

10 Claims, 5 Drawing Figures

BOTTLE STOPPER

This Abstract of the Disclosure is not intended to be taken either as a complete exposition or as a limitation of the present invention, however, the full nature and extent of the invention being discernible only by reference to and from the entire disclosure which follows.

BACKGROUND OF THE INVENTION

The instant invention relates to a dispensing stopper for sealing the necks of bottles, and more particularly to an improved dispensing stopper which is capable of adjusting the flow rate of fluids contained within the bottle.

Combined caps and dispensers are generally known, but they have, in practice, been found to have many disadvantages. Thus, many of the known devices cannot perform the bottle sealing function and be regulatable to insure a wide range of controlled discharge of the container to which they are applied, while others are complicated and expensive to manufacture.

In U.S. Pat. Nos. 2,167,476 and 1,777,826, dispensing stoppers are disclosed which feature diametrically opposed air channels and pouring grooves axially aligned at the periphery of the stopper. However, the dispensing stoppers disclosed in these patents, as well as many other prior art devices, require that the fluid in the container flow through a channel, so that the rate of flow of the fluid is limited by the cross-sectional area of the channel. The instant invention overcomes this problem of limited fluid flow rate by providing a bottle dispensing stopper which is capable of adjusting the flow rate between a fully sealed condition on the one hand and on the other hand a wide range of flow rates entirely independent of and not limited by the cross-sectional area of any axial groove or channel through which the liquid must flow. This is accomplished by providing an internally hollow stopper (rather than the solid stoppers of the above-cited patents) which includes an axial slot, rather than a channel or groove, through which the liquid flows. Provision of the axially extending slot results in a pouring opening the size of which depends entirely on the length of the slot exposed, i.e., the axial position of the stopper.

SUMMARY OF THE INVENTION

The instant invention provides a hollow stopper for dispensing fluid from a bottle having a neck and a top lip. The stopper comprises a top wall having a laterally extending, downwardly open, spout-like protrusion, said top wall having an annular, continuous, uninterrupted undersurface for sealing engagement with the top lip of a bottle. The stopper further comprises an annular skirt depending from the top wall inwardly of the top wall undersurface, said skirt being adaptable to fit within the neck of a bottle and to move axially with respect thereto between a sealing position in which said undersurface is in sealing engagement with the bottle lip and a range of dispensing positions in which said undersurface is spaced from the bottle lip. The skirt includes an elongated, substantially axial pouring slot extending from the top wall undersurface along one side of the skirt and in substantial alignment with the spout-like protrusion and a continuous, air admitting channel extending downwardly from the top wall undersurface along the opposite side of the skirt substantially coextensive with said pouring slot.

DESCRIPTION OF THE PREFERRED EMBODIMENTS

Figures 1, 2, 3, 4, 5:
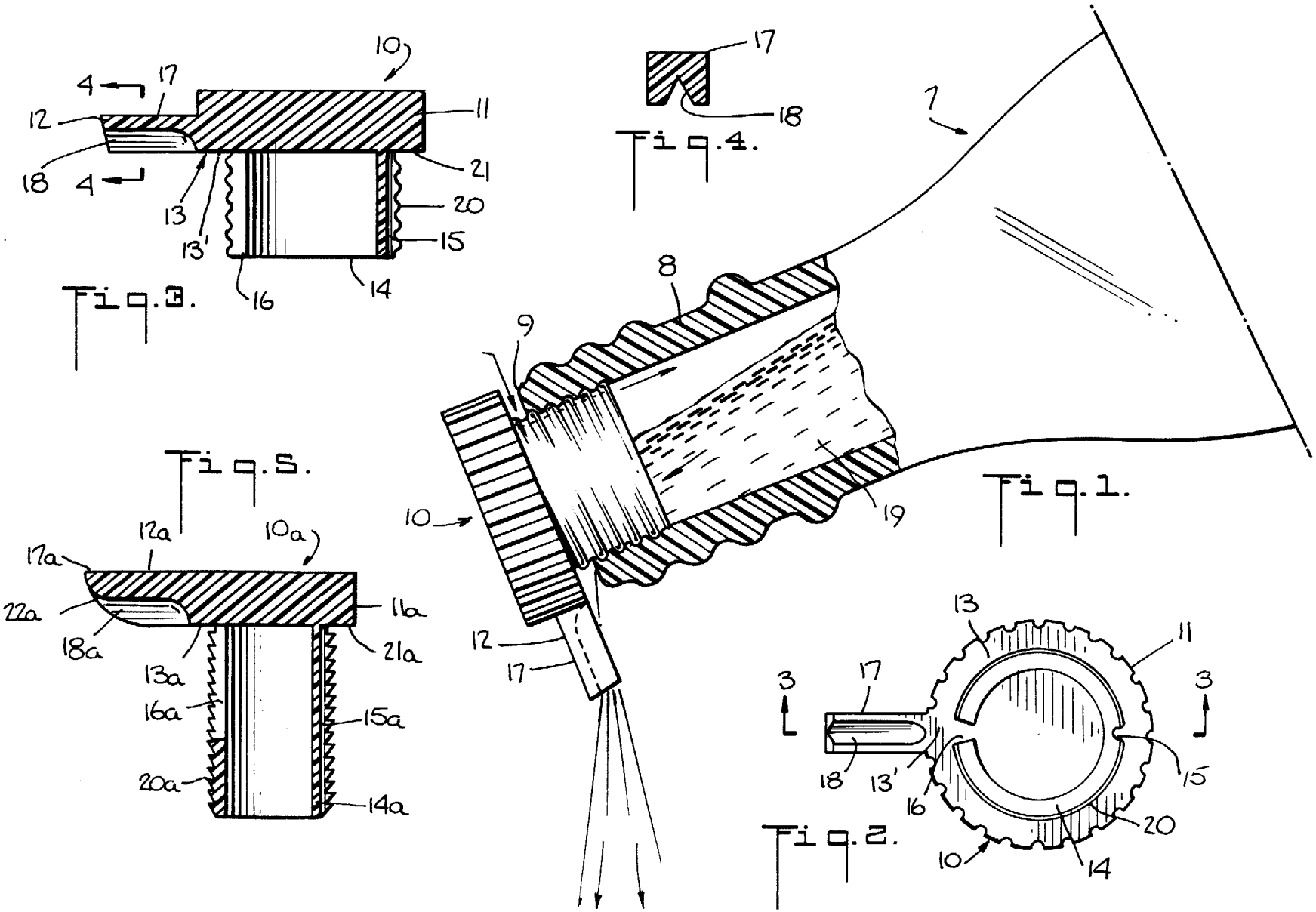
FIG. 1 is a vertical sectional view of a bottle with liquid and a dispensing stopper therefor in accordance with the instant invention.
FIG. 2 is a bottom plan view of the dispensing stopper shown in FIG. 1.
FIG. 3 is a vertical, sectional view taken on the plane indicated by the line 3—3 in FIG. 2.
FIG. 4 is an enlarged, sectional view on the plane indicated by the line 4—4 in FIG. 3 showing the pouring spout.
FIG. 5 is a vertical, sectional view of an alternative embodiment of a dispensing stopper in accordance with the instant invention.

In describing the preferred embodiment of the instant invention, reference is now made to the drawings, wherein FIG. 1 depicts a bottle generally designated 7 having a neck portion 8 and a top lip 9 thereon, and a hollow, externally threaded dispensing stopper or bottle top generally designated 10 for sealing the bottle 7 and adjusting the flow rate of the fluid 19 therein between a fully sealed condition (not shown) and a wide range of other flow rates, one of which is shown in FIG. 1.

Referring now to FIGS. 2 and 3, the dispensing stopper 10 includes a top wall 11 having a laterally extending, downwardly open, spout-like protrusion 12. The wall 11 also includes an annular, circumferentially continuous, uninterrupted undersurface 13 for sealing engagement with the top lip 9 of the bottle 7. The undersurface 13 includes a peripheral edge 21. The stopper 10 further comprises a hollow, annular skirt or stopper portion 14 depending from the top wall 11, and spaced from and within the peripheral edge 21 of the undersurface 13.

A continuous, preferably axial, air admitting channel 15 extends preferably along the full length of the skirt 14 on one side thereof while substantially diametrically opposed to said air admitting channel 15 is an axial slot 16 extending from the undersurface 13 of the top wall 11 the entire length of the skirt 14. In alignment with the slot 16 is a laterally extending spout 17 having a downwardly open, radially extending, inverted V-shaped pouring groove 18 (see FIG. 4) terminating at the top wall undersurface 13. The skirt 14 further includes an external surface of threads 20 to facilitate engagement with the interior surface of a bottle neck.

An important feature of the instant invention is the capability to adjust the flow rate of the fluid 19 while still being able to form a seal in the fully closed position of the stopper 10. This result is achieved through recognition of the principle that the fluid escaping through the slot 16 will flow across the undersurface 13 in the region 13' without requiring a groove in such flat undersurface to direct the liquid into the pouring groove 18 when the groove 18 is pointed downwardly during pouring. Thus, when the stopper 10 is partially unscrewed from its sealed position, fluid can flow through the exposed portion of the slot 16, along the adjacent portion 13' of the flat undersurface 13 and then into and along the pouring groove 18 of the spout 17. The slot 16 which permits the fluid 19 to flow through rather than along the skirt 14 results in a pouring opening the size of which depends entirely on how much of the slot 16 is exposed (i.e., axial position of the stopper 10) and is not limited by the cross-sectional area of the slot 16.

The stopper 10 of the instant invention may be formed from several materials, but either polypropylene or high density polyethylene are preferred. If the stopper 10 is formed of one of these relatively rigid materials and the interior surface of the bottle neck is formed of a relatively soft material, the stopper 10 may be self-tapping into the interior of such bottle neck. An alternative embodiment of a stopper, designated 10*a*, shown in FIG. 5, differs from that shown in FIG. 1 by having threads 20*a* with sharp edges to allow a "push" down when assembling the stopper 10*a* into a relatively softer bottle neck and by having a slot 16*a* which, while being elongated, does not extend the full axial length of the skirt 14*a*. It should be noted, however, that it is not necessary that the external surface of the skirt have any threads at all, although the provision of threads does facilitate adjustment of the stopper with respect to the neck of a bottle both for sealing and for finer adjustment of flow control. It has also been learned that the use of multiple threads is advantageous for the reasons that an airtight fit along the threads is attained whereby there is no leakage therethrough, and smooth, continuous pouring is effected owing to the absence of air leakage along the threads. Multiple threads also permit relatively large adjustment of flow rate in response to relatively little rotation of the stopper within the neck of the bottle. The embodiment of FIG. 5 also includes a spout 18*a* having a leading end 22*a* which is arcuate.

The slot 16 need not extend the full length of the skirt 14 as shown in FIG. 3 but may extend for only a portion of the skirt length, as illustrated in the alternative embodiment shown in FIG. 5. The use of a fully extended slot 16, however is helpful to the adaptability of the stopper to bottle necks having widely varying internal dimensions due to manufacturing tolerance since it makes the skirt more flexible. Thus, when the slot 16 does not extend the full length of the skirt 14, it is advisable to employ a deeper air channel 15 extending nearly the entire thickness of the skirt wall in order to achieve a "spring" action for providing adaptability to bottle neck dimension variations.

As best seen in FIG. 4, the preferred embodiment for the pouring groove 18 in the spout 17 is an inverted V. This V-shaped groove design has been found to cut off the flow faster than other known designs and provides for essentially dripless pouring.

One embodiment of the present invention which has been found to function satisfactorily with fluids having approximately the viscosity of water has the following approximate dimensions in inches: (*a*) length of slot 16 = 9/16; (*b*) width of slot 16 = 5/32; (*c*) length of skirt 14 = 15/16; (*d*) length of spout 17 = ¾; (*e*) depth of V groove 18 = 3/16; (*f*) diameter of top wall 11 = 1-3/16; (*g*) outside diameter of skirt 14 including threads 20 = 0.835; (*h*) quadruple thread 20 (four per inch lead) 0.031 deep and 1/16 pitch; (*i*) air channel 15 length and width = 15/16 and 0.090; (*j*) thickness of skirt wall 14 = 0.050 plus thickness of thread 20.

It will be understood that stoppers according to the present invention can be used with glass bottles as well as with plastic bottles. The bottles need not be threaded at the interior of the neck. With glass bottles having a smooth neck interior the threaded stoppers will nevertheless permit fine adjustment when screwed in or out. With plastic bottles the stopper can be self tapping or not depending on the material of the bottle. It will be seen that the stopper of the present invention can be used with a wide variety of bottle materials and neck tolerances.

When the stopper is being used in conjunction with a glass bottle, which has a rounded rib on the top of its neck, it may be useful to provide the stopper with a mating, i.e., concave undersurface in order to properly seal the glass bottle. It should also be noted that greater pouring accuracy can be achieved by lengthening the pouring spout 17. Also, the width of the slot 16 may be varied to suit the viscosity of the fluid to be dispensed. It has been observed that the dispensing stopper of the instant invention functions well with fluids having viscosities approximately that of water.

Without further analysis, the foregoing will so fully reveal the gist of the present invention that others can by applying current knowledge readily adopt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A hollow stopper for dispensing liquid from a bottle having a neck and top lip, comprising:

a top wall having a laterally extending, downwardly open, spout-like protrusion, said wall having a continuous annular undersurface for sealing engagement with the top lip of a bottle; and an annular skirt depending from the top wall inwardly of said undersurface, said skirt being adapted to fit within the neck of a bottle and to move axially with respect thereto between a sealing position in which said undersurface is in sealing engagement with the top of the bottle and a plurality of dispensing positions in which said undersurface is spaced from the top lip of the bottle, said skirt defining a hollow, central cavity opening toward the interior of the bottle and said skirt having an elongated substantially axial pouring slot extending through said skirt from the top wall undersurface along one side of the skirt and in alignment with the spout-like protrusion and a continuous, substantially axially extending, air-admitting groove along the outer, opposite side surface of the skirt spaced from the pouring slot and extending from the top wall undersurface towards the free end of the skirt but not extending through the skirt, so that when the stopper is positioned on the neck of a bottle with said undersurface spaced from the lip of the bottle, liquid from the interior of the bottle can flow into said cavity and thence through said slot, over said undersurface and along said spout-like protrusion for dispensing such liquid at a desired rate.

2. The stopper of claim 1, wherein the spout-like protrusion includes a downwardly open, radially extending pouring groove.

3. The stopper of claim 2, wherein the pouring groove comprises an inverted V-shape.

4. The stopper of claim 1, wherein the external surface of the annular skirt includes threads for engagement with the interior surface of a bottle neck.

5. The stopper of claim 4, wherein the threads are characterized by sharp edges to facilitate self-tapping of the skirt into the interior of a bottle neck of softer material.

6. The stopper of claim 1, wherein the stopper comprises polypropylene.

7. The stopper of claim 1, wherein the axial pouring slot extends the full length of the skirt.

8. The stopper of claim 1, wherein the leading end of the spout-like protrusion is arcuate.

9. The stopper of claim 1, wherein said air admitting groove is diametrically opposite said pouring slot and extends axially the full length of said skirt.

10. A bottle top for dispensing liquid from a bottle having a neck and a top lip, comprising:

a cap portion having an annular circumferentially continuous and uninterrupted undersurface adapted to sealingly engage the top lip of the bottle, said cap portion having outwardly of said annular undersurface a laterally extending protrusion having a downwardly open radially extending pouring groove; and a hollow annular stopper portion depending from said cap portion inwardly of said annular undersurface, said hollow annular stopper portion being adapted to fit within the neck of the bottle, and having an axial pouring slot extending downwardly from said undersurface of said cap portion along one side of the stopper portion and in alignment with said pouring groove and a continuous air-admitting groove along the outer side surface of said stopper portion extending substantially the full axial length of the outer side surface of said stopper portion substantially diametrically opposite said pouring slot but not extending through said stopper portion;

said bottle top being adapted to move axially with respect to the neck of the bottle between a sealing position in which said undersurface is in sealing engagement with the top lip of the bottle and a plurality of dispensing positions in which said undersurface is spaced from the top lip of the bottle and in which said pouring slot is in communication with the atmosphere so that when the stopper is positioned on the neck of a bottle with said undersurface spaced from the lip of the bottle liquid from the interior of the bottle can flow into said undersurface and along said spout-like protrusion for dispensing such liquid at a desired rate.

* * * * *